US005092081A

United States Patent [19]

Crouch et al.

[11] Patent Number: 5,092,081

[45] Date of Patent: Mar. 3, 1992

[54] FIVE-WAY ADJUSTABLE FORM BLOCK HOLDER WITH FLOAT CAPABILITIES

[75] Inventors: Robert H. Crouch; Eugene M. Hoganson, both of West End, N.C.

[73] Assignee: Crouch Machinery, Inc., Pinehurst, N.C.

[21] Appl. No.: 550,082

[22] Filed: Jul. 9, 1990

[51] Int. Cl.[5] ..... B24B 21/08

[52] U.S. Cl. ..... 51/141; 51/148; 51/135 BT

[58] Field of Search ..... 51/141, 148, 135 R, 51/135 BT

[56] References Cited

U.S. PATENT DOCUMENTS

| | | | |
|---|---|---|---|
| 1,478,044 | 12/1923 | Mattison | 51/141 |
| 1,684,464 | 9/1928 | Young | 51/141 |
| 1,986,521 | 1/1935 | Oakley | 51/141 |
| 2,166,676 | 7/1939 | Breed | 51/141 |
| 2,363,728 | 11/1944 | Grunwald | 51/135 |
| 2,421,289 | 5/1947 | Roth et al. | 51/141 |
| 2,456,217 | 12/1948 | Rothrock | 51/138 |
| 2,479,506 | 8/1949 | Payton | 51/138 |
| 2,693,669 | 11/1954 | Riedesel | 51/141 |
| 2,747,341 | 5/1956 | Heesemann | 51/141 |
| 3,180,061 | 4/1965 | Schuler | 51/137 |
| 3,250,044 | 5/1966 | Steffen | 51/141 |
| 3,654,739 | 4/1972 | Stoy et al. | 51/141 |
| 4,031,668 | 6/1977 | Lasko, et al. | 51/137 |

FOREIGN PATENT DOCUMENTS

| | | |
|---|---|---|
| 843012 | 7/1952 | Fed. Rep. of Germany . |
| 2154580 | 11/1971 | Fed. Rep. of Germany . |
| 107915 | 11/1924 | Switzerland . |

*Primary Examiner*—Robert A. Rose

*Attorney, Agent, or Firm*—Watson, Cole, Grindle & Watson

[57] ABSTRACT

A form block holder is provided for an endless belt type working machine such as a sander. Positioning of the block relative to the belt is provided in five distinct directions, i.e., up/down, forwards/backwards, yaw, pitch and roll, by a series of adjustments of interconnected shafts and sleeves. A float mode is also provided which yields to forces that tend to rotate the form block about an axis parallel to the belt travel and parallel with a support table, i.e., the pitch axis. A first end float shaft is surrounded by a support sleeve at one portion and is threadingly received in a handle. The remainder of the float shaft is surrounded by a cam sleeve comprising a first cam sleeve section ultimately connected to the form block holder and a second cam sleeve section. A spring biased washer is provided within the support sleeve about the float shaft and abuts the second cam sleeve section. To establish the float mode, a gap is provided between the support sleeve and the second cam sleeve section. Thus, pitch inducing forces cause the first cam sleeve section and form block holder to rotate about the float shaft, which in turn cause the second cam sleeve section to compress the spring biased washer. Once these forces terminate, the spring biased washer urges the second cam sleeve section back to its original position, whereby the first cam sleeve section and the form block holder are rotated back to their original positions.

25 Claims, 4 Drawing Sheets

FIVE-WAY ADJUSTABLE FORM BLOCK HOLDER WITH FLOAT CAPABILITIES

BACKGROUND OF THE INVENTION

1. Technical Field of the Invention

The present invention relates generally to an adjustable form block holder for any endless belt type working machine and more particularly to such a block holder which is adjustable in five directions as well as having a float capability.

2. Discussion of the Related Art

Endless belt type working machines perform a wide variety of functions on a workpiece including sanding, grinding, buffing, polishing, form shaping, etc. Basically, contact between the driven, abrasive endless belt and the workpiece is adjusted to the desired degree and position by either changing the position of the workpiece by adjusting a supporting table relative to the belt or by adjusting the belt relative to the workpiece. In this latter adjustment, a form block or other object contacts the side of the endless belt opposite the workpiece and is adjusted to change the path of abrasive belt relative to the workpiece as job demands change. Form block adjustment is desired in five directions, i.e., in/out, up/-down and about three mutually perpendicular axes relative to the belt.

Numerous devices have been proposed to accomplish one or at most a few of these desired directional adjustments. However, none accomplish adjustment in all of the desired directions. Any attempted combination of known apparatuses would result in a very complicated and cumbersome mechanism.

In addition, its often desirable to provide for the block to "float", i.e., to yield to forces that tend to rotate the block about an axis parallel to the direction of belt travel and to then remove or return the holder to its original position when these forces are removed. These forces may be generated by contact of the form block, via the belt, with a warped workpiece.

Accordingly, it is an object of the present invention to provide for such a float mode.

It is another object of the present invention to provide a form block holder mechanism which allows for positioning and securing in five directions relative to the endless belt.

It is a further object of the present invention to accomplish the foregoing objects in a single simple device.

Additional objects and advantages of the present invention are apparent from the specification and drawing which follow.

SUMMARY OF THE INVENTION

The foregoing and additional objects are obtained by a form block holder according to the present invention. A lower base portion is fixed relative to the support table within the inner faces of the endless belt drive of any suitable working machine. An upper base portion is slidingly received by the lower base portion and is translated along an axis parallel to the table and perpendicular to the direction of belt travel by a threaded handle which is threadingly received in the upper base portion and supported by locking collar connected to a bracket fixed to the table. Once the desired in/out position is obtained, a screw is tightened through the upper base position against the threaded member.

An upright shaft extends perpendicularly from this upper base portion and is surrounded by an L-shaped sleeve having a lower leg extending perpendicularly from the shaft. The sleeve can be positioned along the axis of the upright shaft by rotating a threaded handle which engages a like-threaded receptacle in the L-shaped sleeve and is co-axial with the upright shaft. Once the desired up/down position is obtained, a screw is tightened through the sleeve to contact the upright shaft to secure the position.

The upright shaft is rotatably journalled within the upper base portion and secured via a screw passing through this portion. The screw is loosened to allow rotation of the shaft about its axis, i.e., yaw of the form block, and then tightened to secure this position.

A roll shaft is received in the lower leg of the L-shaped sleeve and can be manually rotated about its central axis. A screw passes through the lower leg and is loosened to permit rotation and tightened to secure the desired position.

A float shaft is arranged perpendicularly relative both to the roll shaft and to the upright shaft. A first end of the float shaft passes through a clamp having a screw and located on the end of the roll shaft. A knuckle is connected at one end to a snap ring of this float shaft first end and at another end to a form block holder which contains the form block for contacting the endless belt. The float shaft, knuckle and the form block holder are rotated within the clamp with the clamp screw loosened to accomplish a rolling motion of the form block and then the clamp screw is tightened to secure this position.

The float shaft and its associated components also achieve the desired floating mode. A first cam sleeve is connected to the knuckle and surrounds a portion of the float shaft. A second cam sleeve surrounds an adjacent portion of the float shaft and has an edge inclined or angled non-perpendicularly relative to the float shaft central axis which mates with an oppositely inclined edge of the first cam sleeve. A stop sleeve abuts a turning handle threaded about a float shaft second end and surrounds the remainder of the float shaft. A spring biased washer is located within the stop sleeve and contacts the second cam sleeve. A gap is provided between the second cam sleeve and the stop sleeve and may be widened or narrowed by turning the handle in the appropriate direction. Thus, the first cam sleeve, knuckle and form block can rotate about the float shaft when confronted with rotating forces and then be returned to their original position via the spring biased second cam sleeve when these forces are removed.

DETAILED DESCRIPTION OF THE PREFERRED EMBODIMENTS

Figure 1:
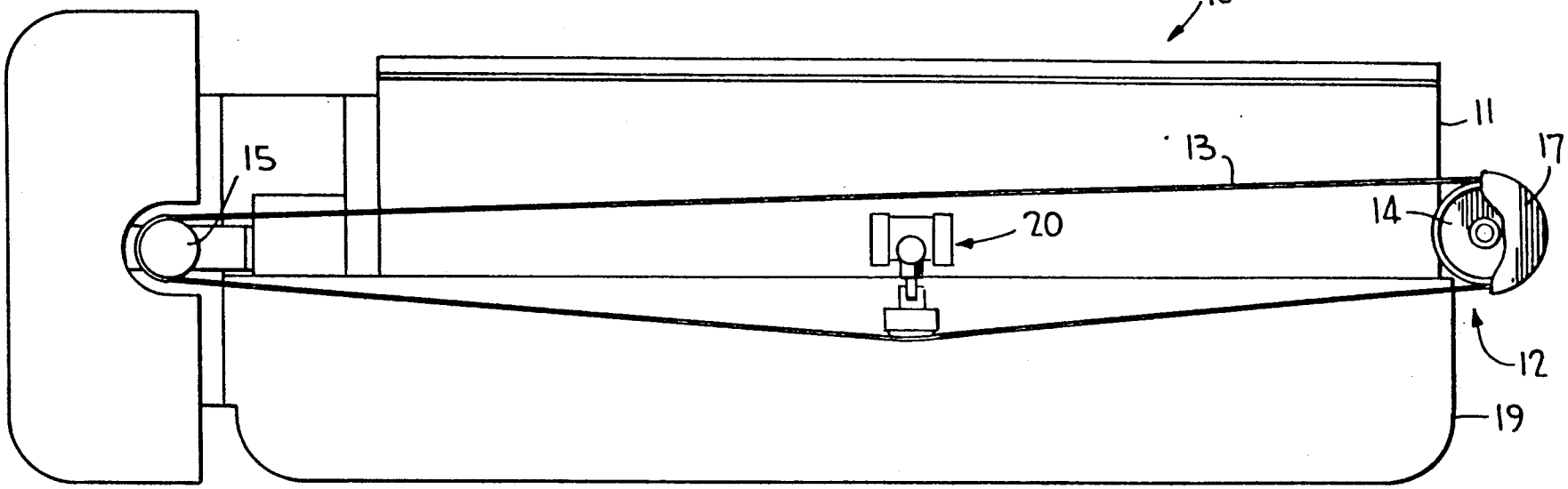
FIG. 1 is a top plan view of a standard endless belt apparatus with the holding mechanism of the present invention schematically represented.

Referring now to FIG. 1, wherein like reference characters refer to like and corresponding parts throughout the several views, a belt apparatus is generally designated 10 and includes a support frame or table 11 to which a belt working machine 12 is mounted in any normal manner. The belt working machine includes an endless abrasive belt 13 trained over both a drive roll 14 and a driven idler roll 15, each suitably mounted on the frame for rotation about fixed upstanding axes. A drive motor 16 is operatively coupled to drive roll 14, and the drive roll may be protected by a cover 17. A standard backup platen is normally mounted on the frame over which the belt passes during either its clockwise or counterclockwise movement between the rolls, as viewed in FIG. 1. However, in an embodiment of the present invention the back-up platen can be placed with a five way adjustable and floating form block holder 20, shown schematically in FIG. 1 and designated generally by numeral 20 or can be added to the side opposite the back-up platen on a conventional edge belt working machine.

The frame is typically elongated in the longitudinal travel direction of the belt, and an elongated workpiece support table 19 is located along a side of the frame.

The desired workpiece, e.g., wood, plastic, metal or any other material, is placed on support table 19 in suitable contact with belt 13 for sanding, grinding, polishing, buffing, form shaping, etc. The principle task of an edge belt form sander is to remove material from a workpiece. For example, an existing profile may be smoothed by altering the dimensional integrity of the workpiece by removing an equal amount of material from all surfaces of the profile. In addition, a new profile may be generated by removing different amounts of material from various parts of the profile.

The workpiece is fed against the outer face of belt 13 via two distinct actions. First, the workpiece can be thrust against the face of the endless belt without imparting any lateral motion to the workpiece, i.e., without moving the workpiece along the direction of belt travel or oppositely thereto. Such an action is commonly termed plunge or infeed sanding or working. Alternatively, the workpiece may be plunged or infed while simultaneously imparting lateral motion to the part in either the direction of belt or in the opposite direction. This feeding is commonly termed traverse or through-feed sanding or working.

The orientation of the principle axes of the belt 13 with the principle axes of the form block 30 has a great influence on the accuracy and consistency of form block sanding and other work functions. They must be coincident when the belt is engaged with the form block, and the transverse break of the belt, i.e., the displacement of the longitudinal axis from that of the belt as the belt passes over the form block, as it centers and leaves the form block must be minimized to optimize profile accuracy and belt life. One principle axis is transverse to the direction of belt travel and the other principal axis is longitudinal or in line with the direction of belt travel.

The sanding belt will best conform to a shape or profile in the form block if the belt is required to flex about only one axis as it passes over the form block. In the instances where the profile in the form block is female, the single axis flex requirement can be best met by low angles of entry and exit of the belt with the form block.

Figure 2:
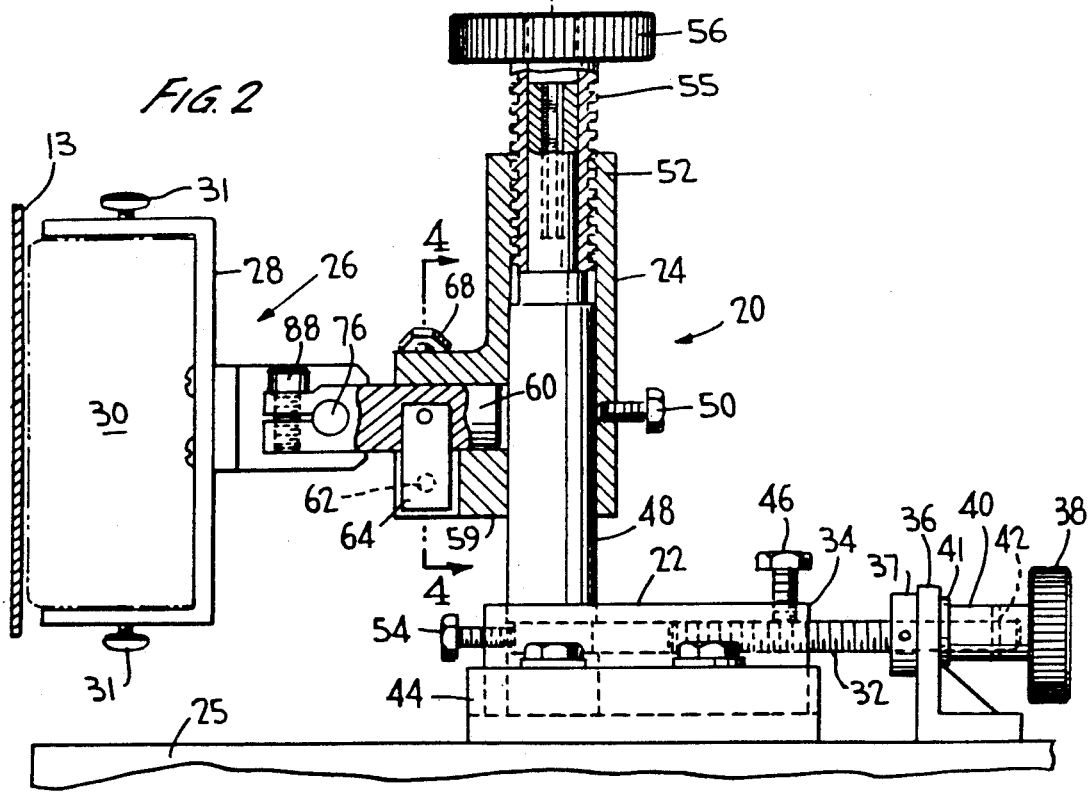
FIG. 2 is a side elevational view, partly in section, of the holding mechanism.

Turning now to FIG. 2, form block holder mechanism 20 has a base 22 which is located on the table between opposite inner faces of the endless belt. An upright generally designated as 24 extends upwardly from and generally perpendicular to base 22. An arm generally designated by 26 in turn extends perpendicularly from upright 24, i.e., parallel to the table, and has a U-shaped form block holder 28 located on its end which firmly grips a suitable form block 30 via appropriate screws 31. Form block 30 in turn contacts the inner face of endless belt 13 in a variety of manners discussed in greater detail below. Form block 30 may comprise any suitable material such as metal, plastic wood, etc. which is sufficiently wear resistant.

The components of and the interaction between base 22, upright 24 and arm 26 will now be described in greater detail.

Base 22 accomplishes the desired in/out movement of form block 30 relative to belt 13 in the manner described below. When through feeding, the depth or aggressiveness of the cut is controlled by a spacing between the belt and the form block. Thus, an in/out movement is needed primarily to control the cut depth. Also, such an in/out movement helps to fine tune the belt, along with the primary adjustment at the idle roller 15 which is movable in and out, as the belt length changes in response to the changes in the ambient temperature and/or humidity. This adjustment thus revises or compensates for destabilizing forces which tend to cause belt 13 to run off the rolls.

Figure 3:
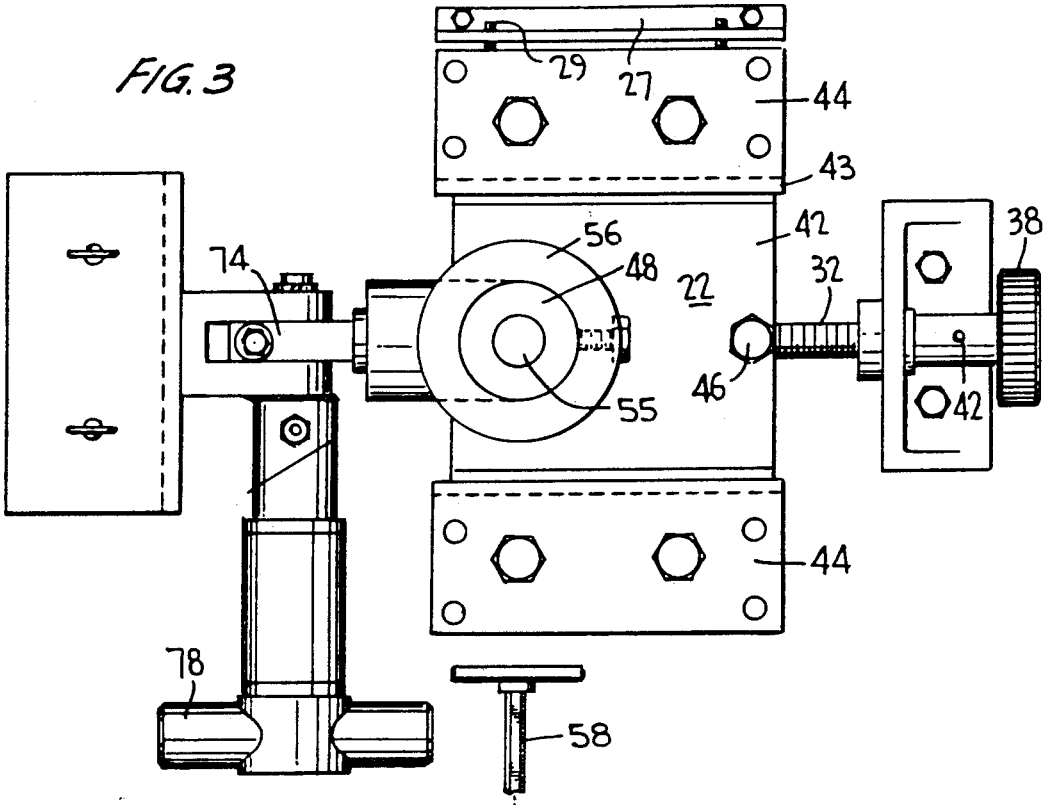
FIG. 3 is a top plan view of the holding mechanism.
Figure 6:
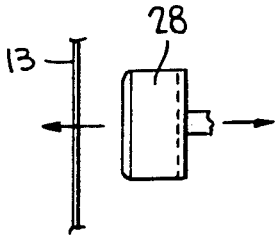
FIG. 6 is a top view showing the in/out movement of the form block holder relative to the endless belt.

As shown in FIGS. 2 and 3, a threaded drive member 32 is engaged at a first end by a like threaded receptacle in a movable upper portion 34 of base 22. Member 32 also passes through and is supported by an L-shaped bracket 36 fixed to the table. A threaded locking collar 37 surrounds threaded drive 32 and abuts one side of bracket 36. A washer 41 abuts the other side of bracket 36. A turning knob 38 is located at the second end of member 32 and is welded to a handle sleeve 40. Slotted spring or roll pin 42 is provided and engages handle sleeve 40 and threaded member 32. By turning knob 38, e.g., clockwise or counterclockwise, threaded member 32 moves the upper portion 34 of base 22 left or right in FIG. 2 along grooved receiving slots 43 in a lower portion 44 of the base 22 which is fixed to the table. Accordingly, the remainder of holder mechanism 20, i.e., interconnected upright 24, arm 26 and particularly block 30, are moved in or out relative to belt 13, as shown in FIG. 6. Once the desired position is reached in this direction, a locking screw 46 passing through upper portion 34 is tightened so as to engage and secure threaded member 32. Of course, this screw is loosened during any turning of the handle for in/out movement.

The upright 24 and its associated components affect an up/down movement of the form block 30 with reference to the fixed table, i.e., a motion that is perpendicular both to the belt travel and to table. Such movement is intended to center form block 30 with respect to endless belt 13. Also, discrete and precise adjustments of the form block 30 vis a vis the workpiece located on the opposite side of belt 13 are possible. In addition, this movement also removes the destabilizinq forces discussed above.

Figure 7:
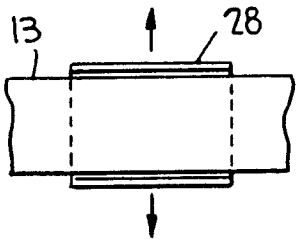
FIG. 7 is a front view showing the up/down movement of the form block holder relative to the endless belt.

Upright 24 comprises an upright shaft 48 which is rotatably journalled in movable upper portion 34 of base 22 and secured relative thereto via screw 54. A movable, L-shaped arm sleeve 52 surrounds the upper portion of shaft 48 and is secured thereto via screw 50. As discussed in greater detail below, sleeve 52 is ultimately connected to form block holder 28 in such a manner that a displacement of sleeve 52 results in a like displacement of holder 28. The interior of the upper leg of sleeve 52 comprises a threaded receptacle which receives a like-threaded handle member 55, which in turn is rotatably journalled at one end within upright shaft 48 and has a turning handle 56 connected to its other end. To accomplish an up/down movement, screw 50 is loosened and then handle 56 rotated in the appropriate direction to move sleeve 52 up or down to the desired position, as shown in FIG. 7. Screw 50 is then tightened to secure this position.

To facilitate assembly, base lower portion 44 and L-shaped bracket 36 may be connected to a base plate 25, which in turn is fixed to frame 11 at any desired location between the inner faces of endless belt 13. An angle iron 27 may be fixed to the base plate or table via appropriate screws and has socket headed set screws 29 passing through the leg facing upper portions 44 and contacting these upper positions. The position of the base may then be fine tuned by adjusting these set screws.

Figure 8:
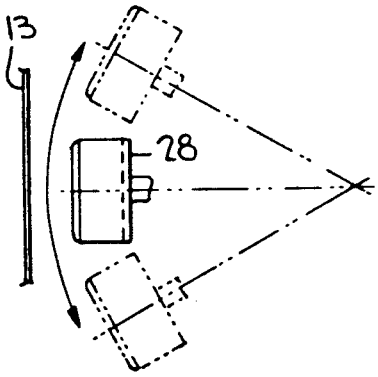
FIG. 8 is a top view showing the rotation of the form block holder about an upright axis extending from the table, i.e., yaw.

To rotate sleeve 52 and ultimately block holder 28 about the central axis of upright shaft 48, i.e., to accomplish yaw, screw 54 is loosened to allow shaft 48 be manually rotated to the desired position, as shown in FIG. 8. Screw 54 is then tightened to secure this position. The purpose of such an adjustment is to maintain the dimensional integrity of an existing profile of the workpiece where the intent is to remove an equal amount of material from all surfaces of the profile, i.e., to smooth an existing profile. In this rotational movement, there is only one position of form block 30 that will result in smoothing an existing profile of the workpiece without distorting the profile. This position is dependent on the type of feeding. When infeed sanding, the workpiece must be plunged squarely into the block. When traverse or through-feeding, the lateral motion of the workpiece must be in a direction such that all elements in the workpiece profile run parallel to the companion elements in the form block.

Figure 9:
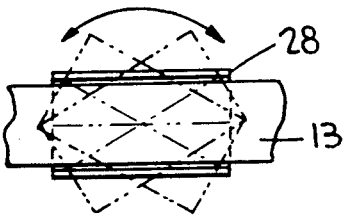
FIG. 9 is a front view showing the rotation of the form block about an axis perpendicular both to the belt travel and to the upright axis, i.e., roll.

A rotation of the block holder 28 about an axis perpendicular to the direction of belt travel and perpendicular to upright shaft 24, i.e., roll of the form block, is also provided by the present invention, as shown in FIG. 9. Such an adjustment is necessary to achieve an accurate duplication of a profile in the workpiece as compared to the profile in the form block. This adjustment is necessary both when infeed sanding and through-feed sanding.

Also, when the sanding belt has been adjusted on the edge belt sander so that it tracks i.e., so that it does not run off the rolls, the direction of travel of the belt along the longitudinal axis will in all likelihood not be perfectly level. The roll adjustment provides the means to optimize the alignment between the sanding belt and the form block. It may be necessary to tilt the table 19 that supports the workpiece so that the tilt of the table surface and the direction of belt travel, i.e., the belt longitudinal axis, are identical.

Figure 4:
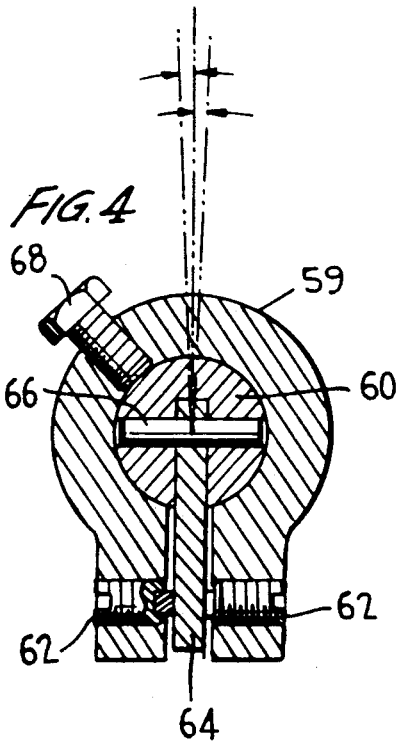
FIG. 4 is a sectional view of the rolling connection of the holding mechanism taken along line 4—4 of FIG. 2.
Figure 11:
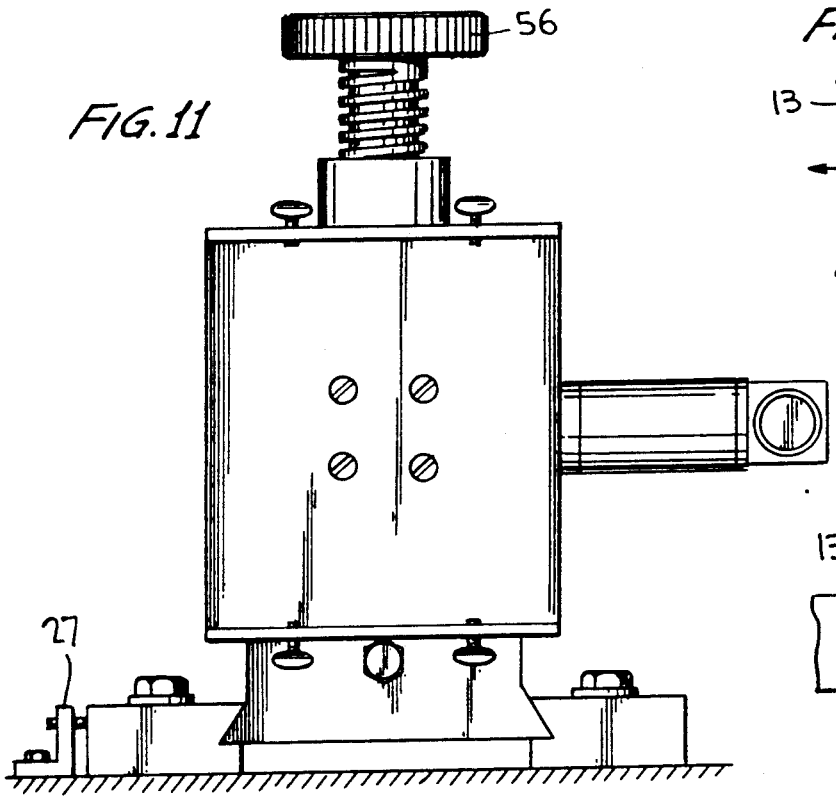
FIG. 11 a front elevational view of the holding mechanism.

Referring now to FIG. 2 and particularly to FIG. 4, L-shaped sleeve 52 has a lower leg 59 which extends perpendicularly relative to upright shaft 48 and which forms a receptacle for receiving a roll shaft 60. The lower portion of leg 59 is split into two sections having screws 62 with nylon inserts that abut stop plate 64. The other end of the stop plate 64 is secured to a spring pin 66 extending through roll shaft 60 and abutting inner walls of lower leg 59. A set screw 68 is provided through an upper portion of lower leg 59 to secure shaft 60 relative to lower leg 59. To adjust the roll of shaft 60 and ultimately connected form block holder 28, screw 68 is loosened and shaft 60 is rotated to the desired position, as shown in FIG. 9 by adjusting screws 62. The extent of rotation is governed by stop plate 64 abutting the opposing screws 62. Screw 68 is then tightened to secure this position, both rotationally and in and out.

Figure 10:
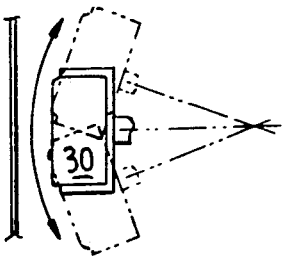
FIG. 10 is a side view showing the rotation of the form block holder about an axis parallel with the belt travel, i.e., pitch.

Adjustment of the pitch of the form block relative to the belt, i.e., a forward/backward tilt, is also possible as shown in FIG. 10. The purpose of this adjustment is to allow the generation of surfaces on the workpiece that are greater or less than 90% of the workpiece surface, e.g., a draft for patterns, chamfers, etc. It is also one of the adjustments required to position the form block so that destabilizing forces are balanced out and removed. Thus, a forward/backward tilt of the holder with reference to the fixed table is desired. The following structural elements and described manipulation accomplish this pitch adjustment.

Figure 5:
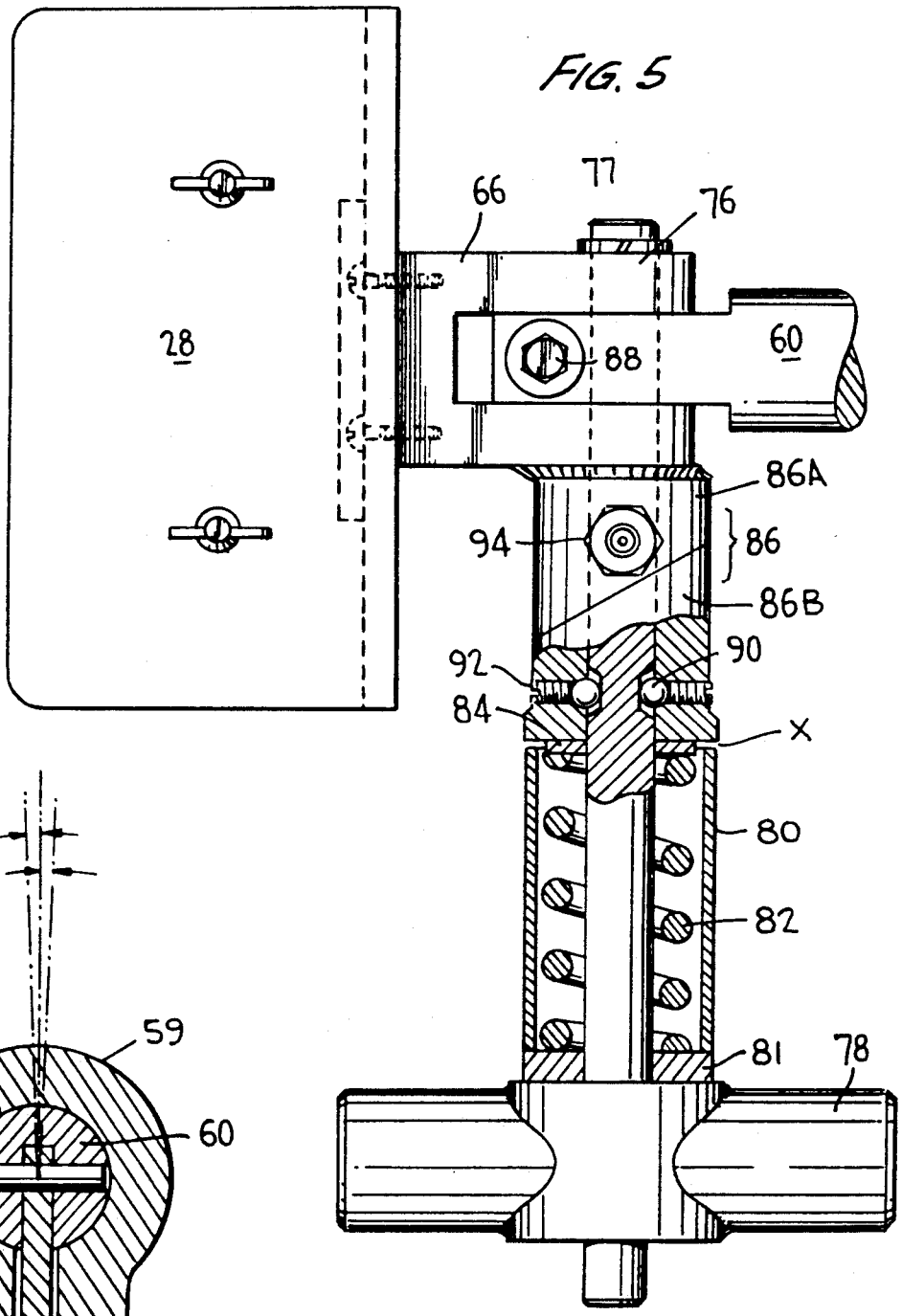
FIG. 5 is a top view, partly in section, of the float shaft and related components of the present invention.

As best shown in FIG. 5, a first end of a float shaft 76 perpendicularly intersects roll shaft 60 and is rotatably connected to a U-shaped knuckle 66 via snap ring 77. Specifically, the distal end of roll shaft 60 forms a clamp about the first float shaft end and a cap screw 88 is provided on this roll shaft clamp to secure the first float shaft end. The second float shaft end is threaded and has a float control handle 78 threadingly connected thereto via an appropriate swage nut (not shown). A mating cam sleeve 86 is provided about the portion of float shaft 76 nearer to knuckle 66 and comprises a first cam sleeve 86A fixed to knuckle 66 and a second cam sleeve section 86B. The mating edges of cam sleeves 86A and 86B are formed along an imaginary line intersecting the central axis of float shaft 76 at a non-perpendicular angle.

A stop sleeve 80 is provided around the second end portion of the float shaft 76 and abuts handle 78 via washer 81. A spring 82 is located about shaft 76 within sleeve 80, abuts washers 81 and 84. Washer 84 in turn abuts second cam sleeve 86B. When handle 78 is rotated, e.g., clockwise or counterclockwise, a gap X between second cam sleeve 86B and stop sleeve 80 can be closed or opened. Steel balls 90 contact a narrowed portion of float shaft 76 and are connected to screws 92 extending inwardly from second cam sleeve 86B.

Figure 13:
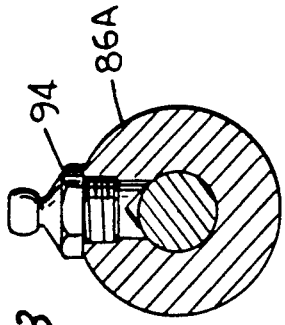
FIG. 13 is sectional view of a turning handle/lubrication joint of the present invention.

To adjust the pitch of form block 30 relative to the belt, the gap X is closed so that cover sleeve 80 and the matched cam sleeve 86 form an integral sleeve about float shaft 76 and can rotate therewith. Next, cap screw 88 is loosened and block 30, knuckle 66 and float shaft 76 are rotated about the float shaft central axis until the desired backward or forward tilt is achieved. Thus, roll about the float shaft central axis is achieved and float shaft 76 serves as an axle for knuckle 66. Screw 88 is then tightened to secure the desired pitch. As shown in FIGS. 5 and 13, a grease fitting 94 is provided for appropriate lubrication of the cam surfaces.

When any of the above described five motions is performed, the remaining four motions are prevented via the tightened associated screws. Thus, in essence each motion is performed in reference to a fixed position relative to the support table and the endless belt.

In addition to these five described motions of the form block 30 relative to the belt 13, i.e., up/down, backwards/forwards, yaw, roll and pitch, the present invention also allows for free floating of the form block relative to the belt. By free floating it is meant that the form block holder 28 can yield to forces that tend to rotate it around the float shaft 76, i.e., pitch forces, and then form block 28 holder can be urged to return to its original, prestress position when these forces are removed. The purpose of this adjustment is to allow uniform pressure to be maintained on the face of a workpiece that is warped by design or by chance. As the workpiece is fed past the form block, the form or profile will be accurately generated in the face of the workpiece when float is provided.

To provide for such floating capabilities, cap screw 88 is first tightened. Handle 78 is rotated, e.g., counterclockwise, to produce a gap X between the second cam sleeve section 86B and the stop sleeve 80. When form block 30 encounters a force which causes form blockholder 28 to tend to rotate about the central axis of float shaft 76, this gap allows for holder 30, knuckle 66 and first cam section 86A to rotate. The rotation of the first cam sleeve displaces the second cam sleeve 86B axially towards handle 78, thereby displacing spring biased washer 84. Once this force is terminated, the spring biased washer returns to its original, prestress position to axially displace the second cam sleeve back to its original position. This displacement simultaneously cams the opposing mated surface of the first cam sleeve such that the first cam sleeve 86A, knuckle 66 and holder 28 are returned to their original, prestress positions.

The maximum rotation of the block holder in this float mode can be adjusted by changing the width of the gap X between second cam sleeve 86B and stop sleeve 80. The forces which resist the rotation of the block holder can be optimized to suit each particular working function and situation by changing the spring preload and rate, which can be accomplished by replacing the spring 82 with another appropriate spring.

A T-handled hex key 58 is also provided for tightening the screws 62 and is conveniently located in a receptacle formed along the center axis of threaded member 55.

Accordingly, the present invention efficiently and compactly provides for movement of the form block in five possible directions relative to the belt, i.e., up/-down, in/out and rotational yaw, roll and pitch. In addition, a float mode is provided which allows for the form block to rotate about its pitch axis when it encounters a deviation and then to return to its original position.

Figure 12:
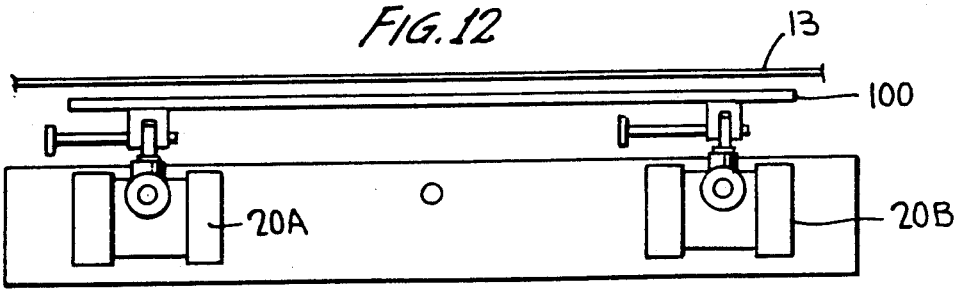
FIG. 12 is an embodiment of the present invention using two form block holder mechanisms.

Referring now to FIG. 12, two form block holder mechanisms 20A and 20B are provided. These two mechanisms are mounted on a swivel plate and are utilized to support a platen or long form 100. This platen, or long form, will have all the adjustments for position as those described for the form blocks. It will be necessary to release one end of the platen 100 from the associated form block holder mechanism during the roll and yaw adjustment and to secure that end again when the adjustment is completed. If desired, more than two form block holder mechanisms can be employed in a similar manner.

The present invention can be utilized to shape rubber, ceramics, plastics, glass, wood, metal, etc., when used on working machines such as molders, routers, edge belt sanders, dowel and rod sanders, tube sanders, etc. The form block holder assembly of the present invention that incorporates five way position adjustments, produces quality form sanding, and provides for easy and secure adjustment when sanding belts are replaced, form blocks are exchanged, starting up for a new run, and/or any other situation that demands adjustments. When two mechanisms are employed, further adjustment combinations may be obtained.

Although the present invention has been described with reference to specific embodiments, various modifications, substitutions and improvements will be apparent to one skilled in the art without departing from the spirit and scope of the present invention as defined herein and in the following claims.

We claim:

1. A free floating mechanism for use in a machine for working a workpiece, the machine comprising an endless working belt having an outer face for contacting the workpiece and being trained over both a drive roll and a driven roll on a table, the free floating mechanism comprising:

a holder for holding a form block which contacts an inner face the belt;

a float shaft having a central axis fixed relative to the belt, a first end of said float shaft rotatably connected to said holder;

a handle threadingly connected to a second end of said float shaft;

a first cam sleeve connected to said holder and surrounding a portion of said float shaft;

a second cam sleeve surrounding an adjacent portion of said float shaft and having an inclined edge which mates with an inclined edge of said first cam sleeve;

a stop sleeve surrounding said float shaft between said second cam sleeve and said handle, said stop sleeve abutting said handle; and means for biasing said second cam sleeve towards said first cam sleeve, whereby a gap is provided between said stop sleeve and said second cam sleeve by turning said handle, whereby said form block holder, said float shaft and said first cam sleeve can yield to forces that tend to rotate them about the float shaft central axis and be returned to their original position via said biasing means once these forces are removed.

2. The free floating mechanism according to claim 1, wherein said biasing means comprises a spring having a first end contacting the second cam sleeve and a second end fixed relative to said float shaft.

3. The free floating mechanism according to claim 1, further comprising means for adjusting and securing the pitch of the form block about an axis parallel both with the belt travel and parallel with the table.

4. The free floating mechanism according to claim 1, further comprising means for adjusting and securing the roll of the form block about an axis perpendicular to the belt travel and parallel to the table.

5. The free floating mechanism according to claim 1, further comprising means for adjusting and securing the yaw of the form block about an axis perpendicular both with the belt travel and the table.

6. The free floating mechanism according to claim 1, further comprising means for positioning the form block up and down relative to the endless belt.

7. The free floating mechanism according to claim 1, further comprising means for positioning the form block in and out relative to the endless belt.

8. A form block holder for use in a machine for working a workpiece, the machine comprising an endless working belt having an outer face contacting the workpiece and being trained for travel over both a drive roll and a driven roll supported on a table, the form block holder comprising:

a lower base portion fixed to the table between inner faces of the belt;

an upper base portion slidingly received by said lower base portion;

means for translating said upper portion relative to said lower base portion along an axis which is perpendicular to the belt travel and parallel with the table;

an upright shaft extending perpendicularly from said upper base portion;

an L-shaped sleeve surrounding said upright shaft and have a lower leg extending perpendicularly from said upright shaft and parallel with the table;

means for positioning side L-shaped sleeve along the central axis of said upright shaft;

means for positioning said L-shaped sleeve about the central axis of said upright shaft;

a roll shaft received at one end in the lower leg of said L-shaped sleeve, said roll shaft having one end forming a clamp;

means for positioning said roll shaft about its central axis;

a knuckle having an axle received by the clamp end of said roll shaft, the axle extending perpendicularly to said roll shaft;

means for positioning said knuckle about its axle; and a form block holder connected to said knuckle, said block holder holding a block which contacts the inner face of the belt.

9. The form block holder according to claim 8, wherein the knuckle axle comprises a free float shaft, and further comprising a handle threadingly connected to a second end of the float shaft;

a first cam sleeve connected to said knuckle and surrounding a portion the float shaft;

a second cam sleeve surrounding an adjacent portion of the float shaft and having an inclined surface which mates with an inclined surface of the first cam sleeve;

a stop sleeve surrounding the shaft and between the second cam sleeve the stop sleeve abutting the handle; and means for biasing the second cam sleeve towards the first cam sleeve, whereby a gap is provided between the stop sleeve and the second cam sleeve by turning the handle, whereby the form block holder, the float shaft and the first cam sleeve can yield to forces that tend to rotate them about the float shaft central axis and be returned to their original position via the biasing means once these forces are removed.

10. The form block holder according to claim 9, wherein the biasing means comprises a spring having a first end contacting the second cam sleeve and a second end fixed relative to said float shaft.

11. The form block holder according to claim 8, wherein said translating means comprises a support bracket fixed to the table, a locking collar connected to the support bracket, and a threaded handle passing through the locking collar and received by a like threaded receptacle in said upper base portion.

12. The form block holder according to claim 8, wherein said means for positioning said L-shaped sleeve along the upright shaft central axis comprises a threaded handle which is received by a like threaded receptacle in an upper leg of the L-shaped sleeve, the threaded handle rotatably journalled to said upright shaft and coaxial therewith.

13. The form block holder according to claim 12, further comprising a locking and unlocking screw passing through said L-shaped sleeve to contact said upright shaft.

14. The form block holder according to claim 8, wherein said upright shaft is rotatably journalled within said upper base portion and said means for positioning said L-shaped sleeve about the upright shaft central axis comprises a screw passing through said upper base portion to contact said upright shaft.

15. The form block holder according to claim 8, wherein said means for positioning said roll shaft about its central axis comprises a screw passing through the lower leg of said L-shaped sleeve to contact said roll shaft.

16. The form block holder according to claim 8, wherein said means for positioning said knuckle about its axle comprises a screw passing through the clamping end of said roll shaft to contact the axle.

17. A combination mechanism for holding a form platen for use in a machine for working a workpiece, the machine comprising an endless working belt having an outer face which contact the workpiece and being trained for travel over both a drive roll and a driven roll supported on a table, the combination mechanism comprising:

two form block holders, each form block holder comprising:

a holder for holding a form block which contacts an inner face the belt;

a float shaft having a central axis fixed relative to the belt, a first end of said float shaft rotatably connected to said holder;

a handle threadingly connected to a second end of said float shaft;

a first cam sleeve connected to said holder and surrounding a portion of said float shaft;

a second cam sleeve surrounding an adjacent portion of said float shaft and having an inclined edge which mates with an inclined edge of said first cam sleeve;

a stop sleeve surrounding said float shaft between said second cam sleeve and said handle, said stop sleeve abutting said handle; and means for biasing said second cam sleeve towards said first cam sleeve, whereby a gap is provided between said stop sleeve and said second cam sleeve by turning said handle, whereby said form block holder, said float shaft and said first cam sleeve can yield to forces that tend to rotate them about the float shaft central axis and be returned to their original position via said biasing means once these forces are removed.

18. The mechanism according to claim 17, wherein said biasing means comprises a spring having a first end contacting the second cam sleeve and a second end fixed relative to said float shaft.

19. The mechanism according to claim 17, further comprising means for adjusting and securing the pitch of at least one form block about an axis parallel both with the belt travel and with the table.

20. The mechanism according to claim 17, further comprising means for adjusting and securing the roll of at least one form block about an axis perpendicular to the belt travel and parallel to the table.

21. The mechanism according to claim 17, further comprising means for adjusting and securing the yaw of at least one form block about an axis perpendicular both with the belt travel and the table.

22. The mechanism according to claim 17, further comprising means for positioning at least one form block up and down relative to the endless belt.

23. The mechanism according to claim 17, further comprising means for positioning at least one form block in and out relative to the endless belt.

24. A combination mechanism for use in a machine for working a workpiece, the machine comprising an endless working belt having an outer face contacting the workpiece and being trained for travel over both a drive roll and a driven roll supported on a table, the mechanism comprising:

two form block holders, each form block holder comprising:

a lower base portion fixed to the table between inner faces of the belt;

an upper base portion slidingly received by said lower base portion;

means for translating said upper portion relative to said lower base portion along an axis which is perpendicular to the belt travel and parallel with the table;

an upright shaft extending perpendicularly from said upper base portion;

an L-shaped sleeve surrounding said upright shaft and have a lower leg extending perpendicularly from said upright shaft and parallel with the table;

means for positioning said L-shaped sleeve along the central axis of said upright shaft;

means for positioning said L-shaped sleeve about the central axis of said upright shaft;

a knuckle having an axle received by the clamp end of said roll shaft, the axle extending perpendicularly to said roll shaft;

means for positioning said knuckle about its axle; and a form block holder connected to said knuckle, said block holder holding a block which contacts the inner face of the belt.

25. The mechanism according to claim 24, wherein each knuckle axle comprises a free float shaft, and each form block holder further comprises a handle threadingly connected to a second end of the float shaft;

a first cam sleeve connected to said knuckle and surrounding a portion the float shaft;

a second cam sleeve surrounding an adjacent portion of the float shaft and having an inclined surface which mates with an inclined surface of the first cam sleeve;

a stop sleeve surrounding the shaft and between the second cam sleeve the stop sleeve abutting the handle; and means for biasing the second cam sleeve towards the first cam sleeve, whereby a gap is provided between the stop sleeve and the second cam sleeve by turning the handle, whereby the form block holder, the float shaft and the first cam sleeve can yield to forces that tend to rotate them about the float shaft central axis and be returned to their original position via the biasing means once these forces are removed.

* * * * *